US007353570B2

(12) United States Patent
Himi

(10) Patent No.: US 7,353,570 B2
(45) Date of Patent: Apr. 8, 2008

(54) SLIDE FASTENER CHAIN

(75) Inventor: Naoyuki Himi, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/417,076

(22) Filed: May 3, 2006

(65) Prior Publication Data

US 2006/0260104 A1 Nov. 23, 2006

(30) Foreign Application Priority Data

May 20, 2005 (JP) ..... 2005-148593

(51) Int. Cl.
*A44B 19/04* (2006.01)

(52) U.S. Cl. ..... 24/405; 24/413

(58) Field of Classification Search ..... 24/403–414; D11/221

See application file for complete search history.

(56) References Cited

U.S. PATENT DOCUMENTS 2,385,020 A 9/1945 Morin
2,564,742 A 8/1951 Wahl
3,055,069 A * 9/1962 Morin ..... 24/410
3,874,038 A 4/1975 Takamatsu
4,152,813 A 5/1979 Heimberger
4,513,483 A 4/1985 Kasai

FOREIGN PATENT DOCUMENTS

DE 954 142 12/1956
DE 2 339 469 2/1974
DE 2951026 A * 7/1981
JP 63-7049 2/1988

* cited by examiner

*Primary Examiner*—James R Brittain
(74) *Attorney, Agent, or Firm*—Alston & Bird LLP

(57) ABSTRACT

A fastener chain, in which fastener elements each formed into a single unit of synthetic resin are attached at a constant interval along opposing side edges of a pair of fastener tapes, a front surface portion and a rear surface portion are provided on the front and rear sides of the fastener element, the surface of the front surface portion is formed into a curved face entirely swelling out circularly and upward while the rear surface portion is formed into a flat plane which is entirely even, and the front surface and the rear surface of the fastener element may have different shapes or the same shape so as to secure a fastener chain having an excellent tactile feel and beautiful appearance.

5 Claims, 10 Drawing Sheets

SLIDE FASTENER CHAIN

BACKGROUND OF THE INVENITON

1. Field of the Invention

The present invention relates to a slide fastener chain in which fastener elements of injection type are attached to opposing side edges of a pair of fastener tapes by injection molding means using synthetic resin.

2. Description of the Related Art

In a fastener element of injection type according to Japanese Utility Model Publication No. 63-7049, as shown in FIG. 12, fastener elements 102 of injection type are attached to opposing side edges 106 of a pair of fastener tapes 104 by injection molding means using synthetic resin such that the front surface and rear surface of each of the fastener elements 102 have different shapes. In the front surface, a leg portion 130 is provided projectingly from a proximal end 140 of the fastener element 102 to a front end thereof, a neck portion 116 is provided in the middle of the leg portion 130, and an expanded coupling head 117 is provided at a front end of the neck portion 116 continuously, and a supporting portion 112 substantially triangular in its plan view, that is, a supporting portion 112 whose lateral width decreases gradually, is provided on the bottom face of the leg portion 130 so as to extend from a beginning point of the neck portion 116 to the front end thereof, the thickness thereof being smaller than that of the leg portion 130 on the upper portion. As a consequence, right and left fastener elements 102 engage each other by the neck portions 116 on the upper portion.

The fastener element 102 of injection type as shown in FIG. 12 is provided with a leg portion 130 on the front surface of the fastener element 102 such that the leg portion 130 extends from the proximal end 140 to the front end, and a constricted neck portion 116 is provided in the middle of the leg portion 130. An expanded coupling head 117 is provided at the front end following the neck portion 116, and a substantially triangular supporting portion 112 in its plan view is provided on the bottom side of the leg portion 130 so as to extend from the neck portion 116 to the front end, the supporting portion 112 being thinner than the leg portion 130 of the upper portion. Therefore, both the front surface and rear surface are formed into a flat plane, thereby providing such a problem that the tactile feeling received from the fastener element 102 is not favorable.

The present invention has been achieved in views of the above-described problem, and a main object of the invention is to provide a slide fastener chain in which the surface on the front surface side of an injection-type fastener element in the fastener chain is formed into a curved face, that is, a circular arc shape, thereby improving a tactile feeling received from the fastener element and securing an improvement of a beautiful appearance in its fastener element row.

Further object of the present invention is to provide the slide fastener chain, wherein the front side and rear side of the injection type fastener element have different shapes, and the surface of the fastener element disposed on the front side is formed into a curved face, thereby securing an excellent tactile feel.

Further object of the present invention is to provide the slide fastener chain, wherein the front surface of the fastener element whose front side and rear side are formed into the same contour is formed into a curved face, thereby securing an excellent tactile feeling.

Further object of the present invention is to provide the slide fastener chain, wherein the curved face formed on the surface of the fastener element in the fastener chain is formed in the width direction of the fastener element, that is, in the longitudinal direction of the fastener element row, thereby securing an excellent tactile feeling.

Further object of the present invention is to provide the slide fastener chain, wherein the curved face formed on the surface of the fastener element in the fastener chain is formed in the length direction of the fastener element, that is, in the horizontal direction of the fastener element row, thereby securing an excellent tactile feeling.

Further object of the present invention is to provide the slide fastener chain, wherein the curved face formed on the surface of the fastener element in the fastener chain is formed in the width direction and the length direction of the fastener element, that is, both in the longitudinal direction and horizontal direction of the fastener element row, thereby securing an excellent tactile feeling.

Further object of the present invention is to provide the slide fastener chain, wherein an excellent curved face is formed on the surface of the fastener element by limiting a value of a curvature radius of the curved face formed on the surface of the fastener element, thereby securing an excellent tactile feeling.

SUMMARY OF THE INVENTION

The above-described objects are achieved by a slide fastener chain equipped with fastener elements made of synthetic resin at a constant interval along opposing side edges of a pair of fastener tapes, being characterized in that each of the fastener elements has a front surface portion and a rear surface portion which oppose each other on front and rear sides of each fastener element, and the front surface portion is formed into a curved face entirely swelling outwardly while the rear surface portion is formed into a flat plane which is even.

As a consequence, the surface of the fastener element of injection type in the fastener chain has a curved face swelling out smoothly and circularly. Thus, the injection type fastener element provides an excellent tactile feeling, thereby obtaining a fastener chain securing an excellent tactile feeling and a beautiful appearance.

Preferably, the front surface portion comprises a supporting portion provided projectingly from a proximal portion to a front end while a width dimension of the supporting portion decreases gradually from a middle portion to the front end, and the rear surface portion comprises the supporting portion provided projectingly from the proximal portion to the front end while the supporting portion is provided with a neck portion in the middle portion and an expanded coupling head at the front end continuously.

Consequently, the supporting portion whose rear surface portion is wider than the front surface portion can be provided at the middle portion of the injection type fastener element, whereby a fastener chain having a beautiful appearance in design terms can be finished easily.

Preferably, the front surface portion and the rear surface portion are formed into a same contour; the supporting portion is provided projectingly from a proximal portion to a front end; a neck portion is provided in a middle portion; an expanded coupling head is provided at the front end continuously with the neck portion; an engaging protrusion is provided projectingly on the neck portion; and an engaging concave portion is provided concavely in the coupling head.

As a consequence, the front surface portion and the rear surface portion of the injection type fastener element are finished into the same contour so that the surface of the fastener element having a high engagement strength can be finished into a beautiful appearance and to have an excellent tactile feel.

Preferably, the front surface portion is formed into the curved face swelling out in a width direction of each fastener element.

Preferably, the front surface portion is formed into the curved face swelling out in a length direction of each fastener element.

Preferably, the front surface portion is formed into the curved face swelling out in a width direction and a length direction of each fastener element.

As a consequence, the curved face provided on the surface of the injection type fastener element is achieved depending on different mounting conditions. Thus, there is an advantage that the curved face can be selected depending on an intended purpose, whereby the fastener chain can be used depending on an intended purpose.

Preferably, the curved face of the front surface portion is formed into a shape whose curvature radius is in a range of 2.5 mm to 8 mm.

As a consequence, the curvature to be provided on the front surface of the injection type fastener element can be achieved easily by using specific values, and they can be adopted easily depending on an intended purpose, thereby providing a fastener chain having fastener elements securing an excellent tactile feel. Therefore, as described above, the effects which the present invention can exert are very remarkable.

DETAILED DESCRIPTION OF THE PREFERRED EMBODIMENTS

Hereinafter, preferred embodiments of the present invention will be described in detail with reference to the accompanying drawings.

Figure 4:
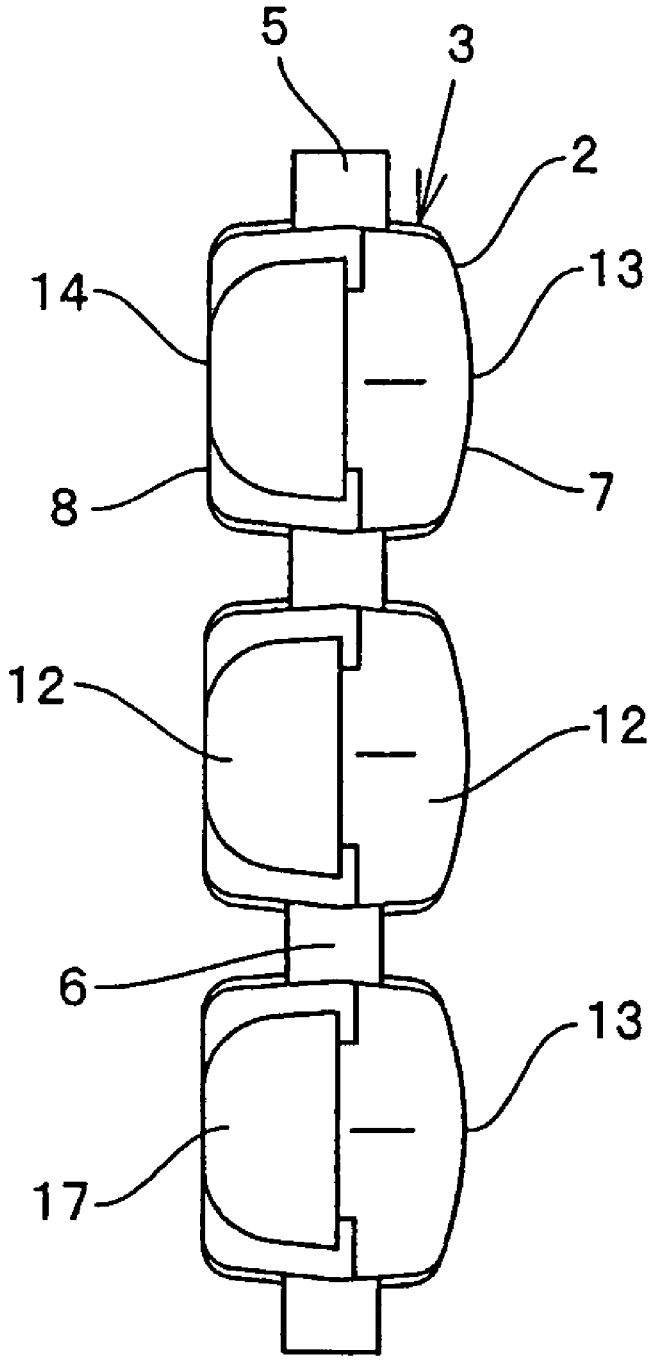
FIG. 4 is a side view showing a side face of the same fastener stringer.
Figure 5:
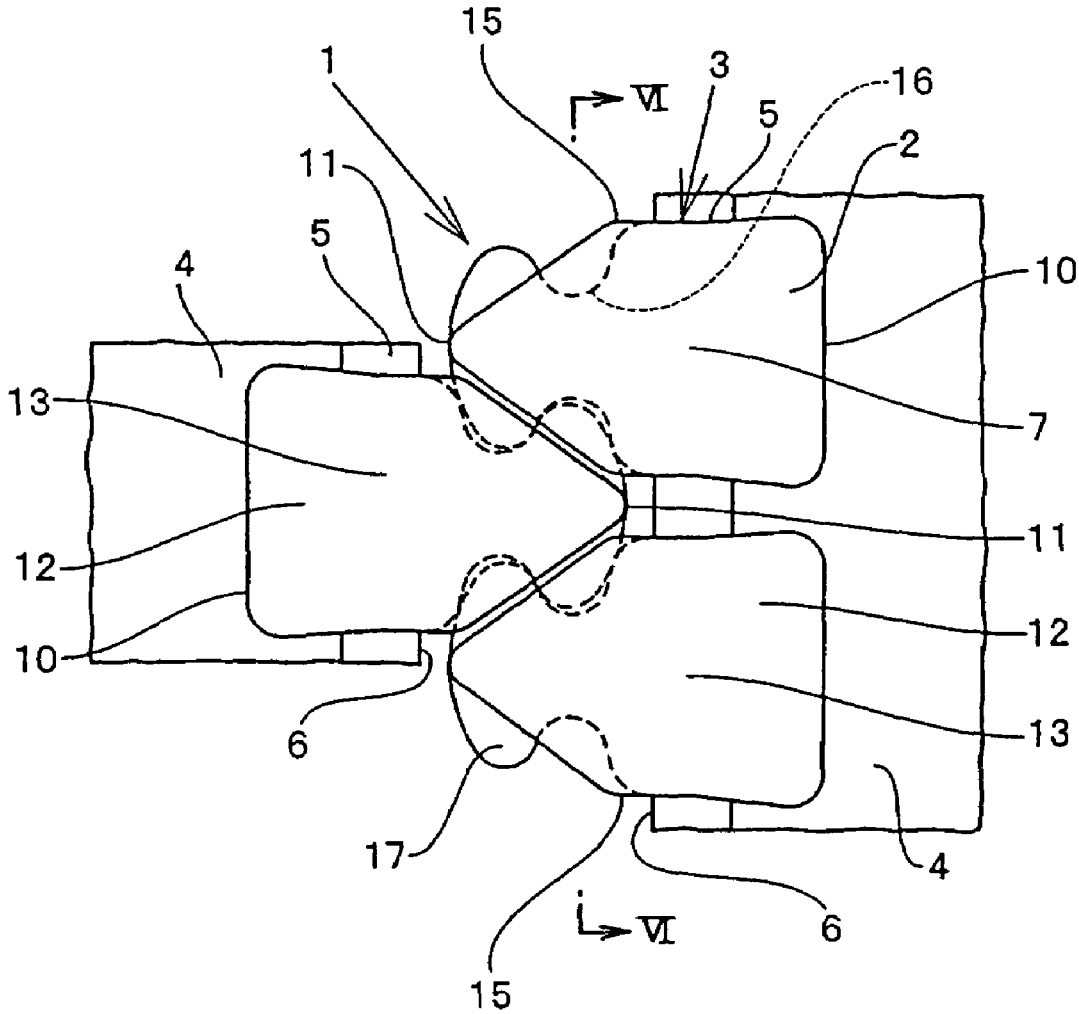
FIG. 5 is a front view showing a state in which the same fastener stringers engage each other.
Figure 6:
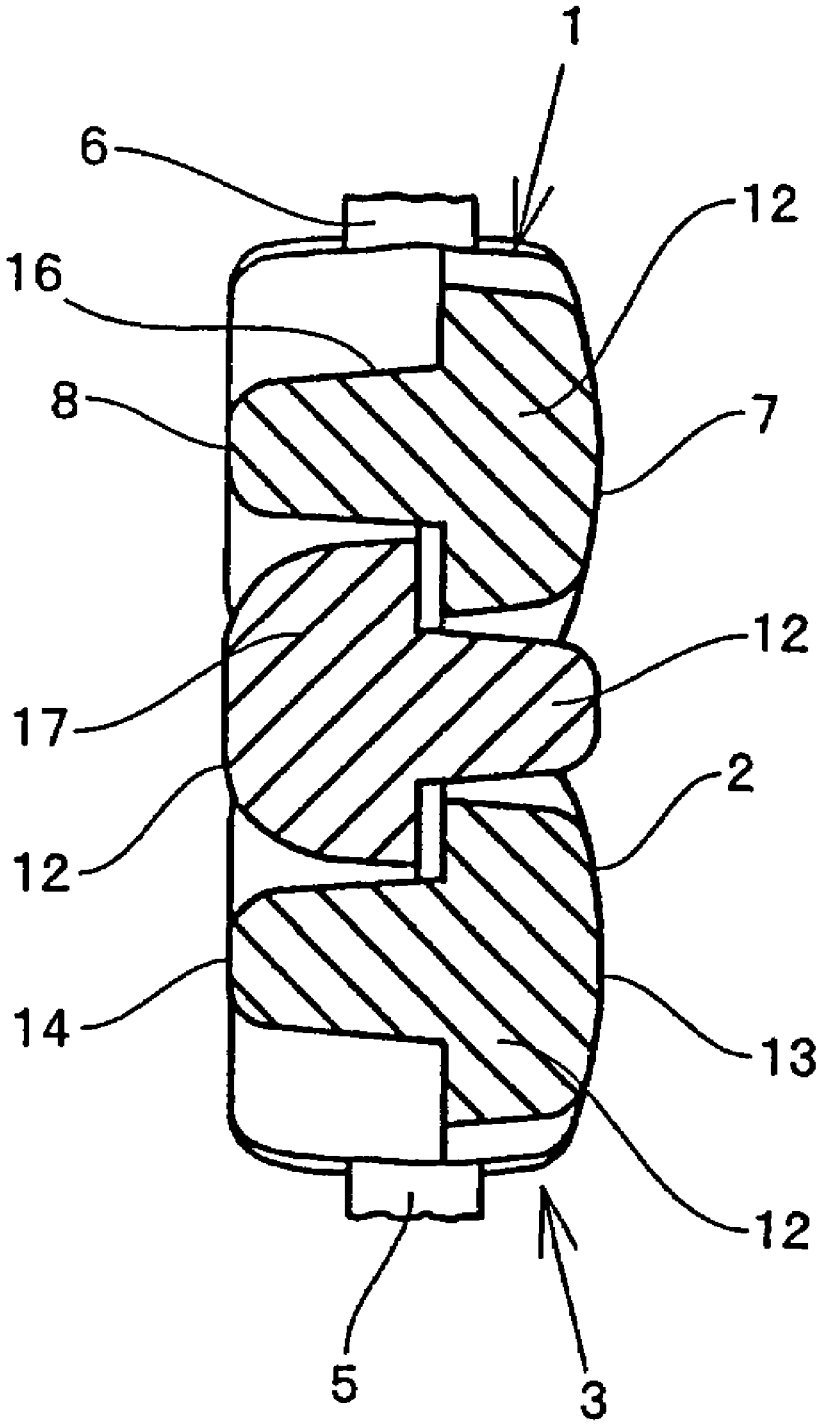
FIG. 6 is a sectional view taken along the line VI-VI in FIG. 5 of the same fastener stringer.
Figure 7:
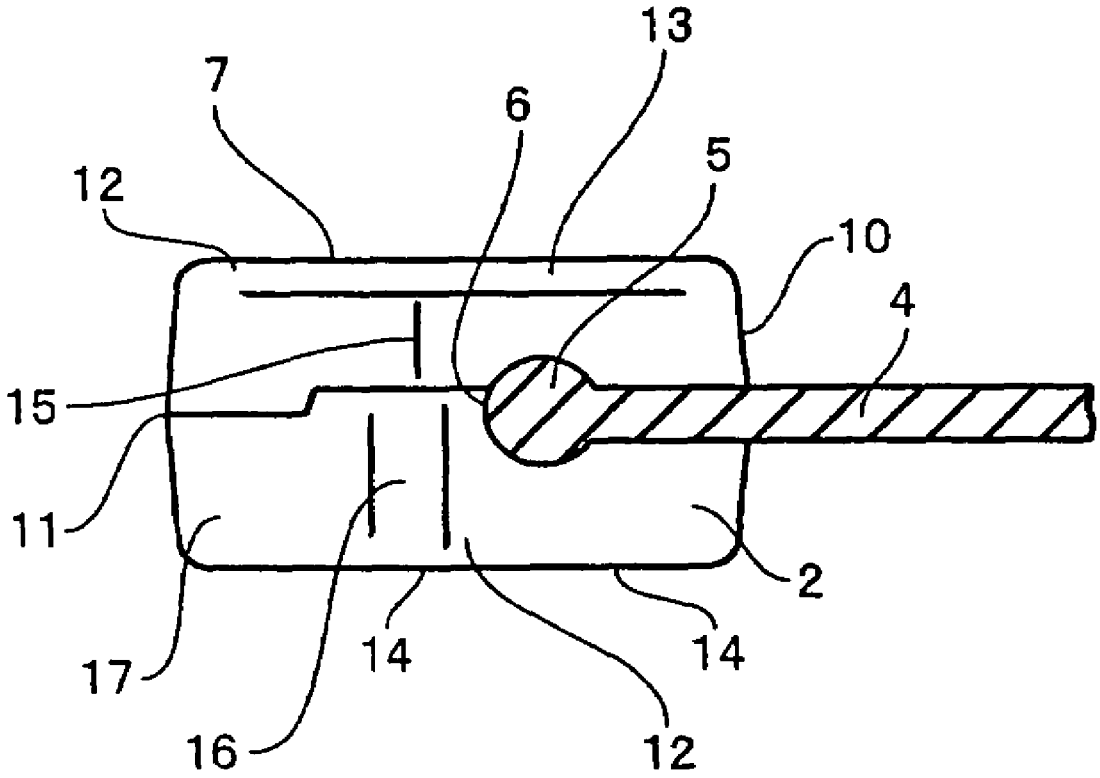
FIG. 7 is a bottom face view showing a bottom face of the same fastener stringer.

As shown in FIGS. 1 to 7, in the fastener chain 1 of this invention, fastener elements 2 of injection type as a single unit are molded by injection molding using synthetic resin at a predetermined interval along opposing side edges 6 of a pair of right and left fastener tapes 4, and the fastener element 2 is comprised of a front surface portion 7 and a rear surface portion 8 opposing each other on the front side and rear side of the fastener elements 2. In the front surface portion 7, a supporting portion 12 is provided projectingly from a proximal portion 10 of the fastener element 2 to a front end 11 thereof, and the supporting portion 12 is formed such that the width dimension of the fastener element 2 decreases gradually as it goes from a middle portion 15 up to the front end 11. The front surface is formed to be a curved face 13 which projects upward along a central line from the proximal portion 10 to the front end 11 on the front surface of the fastener element 2, that is, to be curved in a convex shape in the width direction of the fastener element 2, as shown in FIG. 6. It is preferable to have the shape in which a curvature radius of the curved face 13 exists in a range of 2.5 mm to 8 mm.

Figure 1:
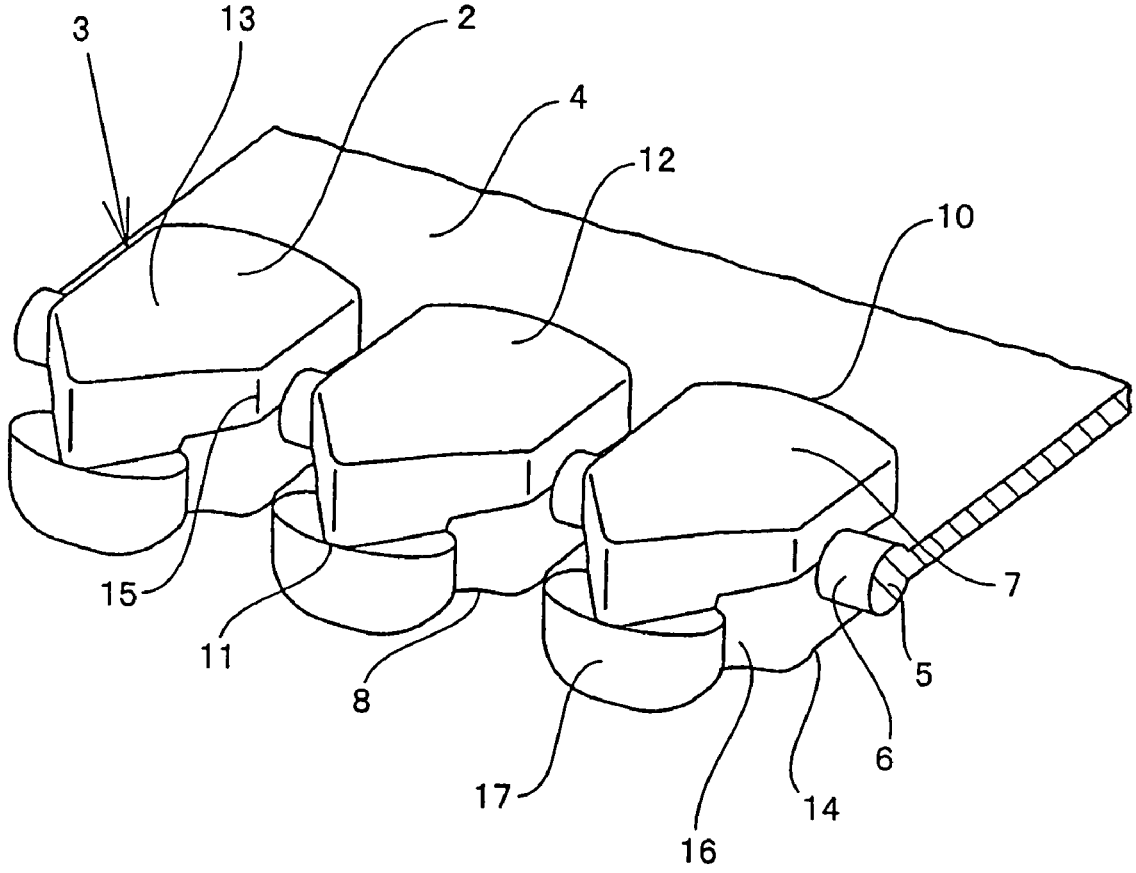
FIG. 1 is a perspective view of a fastener stringer equipped with fastener elements of injection type according to a first embodiment.
Figure 2:
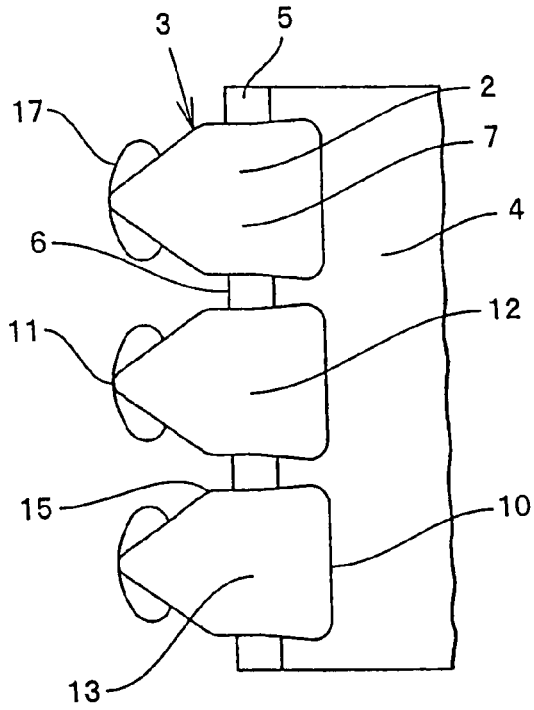
FIG. 2 is a front view showing a front surface of the same fastener stringer.
Figure 3:
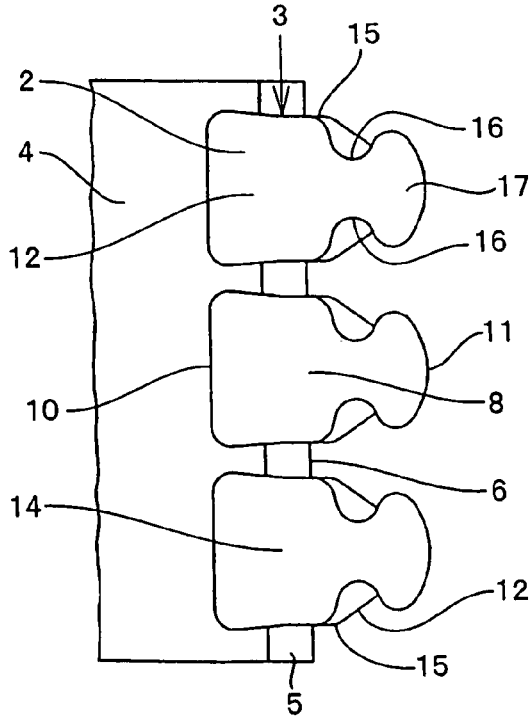
FIG. 3 is a front view showing a rear surface of the same fastener stringer.

In the rear surface portion 8 of the fastener element 2, as shown in FIG. 3, the supporting portion 12 is provided integrally with the front surface portion 7 such that it extends from the proximal portion 10 of the fastener element 2 up to the front end 11 thereof, a constricted neck portion 16 is provided concavely in the middle portion 15 of this supporting portion 12, and an expanded coupling head 17 is provided subsequent to the neck portion 16 on the side of the front end 11. The surface of the rear surface portion 8 is formed into a flat plane 14 as shown in FIG. 4 and the supporting portion 12 of the front surface portion 7 projects to the right and left of the neck portion 16, so that they receive an coupling head 17 of the mating fastener element 2 so as to engage each other as shown in FIG. 5.

The fastener chain 1 of the present invention is formed as described above. When the right and left fastener elements 2 engage each other as shown in FIG. 5, the front surface portion 7 of the fastener chain 1 is curved convexly in the width direction of the fastener element 2. The central line portion from the proximal portion 10 to the front end 11 is formed into the curved face 13 which projects most outwardly. Accordingly, the supporting portion 12 on the front surface of the fastener element 2 in the fastener chain 1 is swollen out widely and circularly, so that the fastener elements have a smooth tactile feel, and the fastener chain 1 can be finished in an excellent appearance.

First Embodiment

A slide fastener chain of the present invention will be described. In a fastener chain 1 according to a first embodiment shown in FIGS. 1 to 7, fastener elements 2 of injection type as a single unit are molded by injection molding means using thermoplastic resin such as polyamide, polyacetal, polypropylene, or polybutylene terephthalate on an expanded core thread 5 provided on opposing side edges 6 of a pair of right and left fastener tapes 4. The fastener elements 2 are arranged by plural quantities at a predetermined interval in the length direction of the fastener chain 1 to form a fastener element row 3. The length direction of the fastener chain 1 is the width direction of the fastener element 2, and a direction perpendicular to the length direction of the fastener chain 1 is the length direction of the fastener element 2.

The fastener element 2 comprises a front surface portion 7 and a rear surface portion 8 disposed on both the front and rear surfaces of the fastener tape 4. In the front surface portion 7, a substantially half portion of the fastener element 2 is provided as a supporting portion 12 from a proximal portion 10 fixed to the fastener tape 4 of the fastener element 2 to a front end 11 projecting outwardly beyond the opposing side edge 6 of the fastener tape 4. This supporting portion 12 is formed into a shape in which the width dimension of the fastener element 2 decreases gradually from the middle portion in the length direction of the fastener element 2 toward the front end 11, that is, a shape providing a substantially triangular shape. Further, the surface of the front surface portion 7 of the fastener element 2 is formed into a shape curving in the width direction of the fastener element 2 such that the central line in the width direction of the fastener element 2 projects most upward in a convex form from the proximal portion 10 of the fastener element 2 to the front end 11 thereof, as shown in FIG. 6.

As shown in FIG. 4, the rear surface portion 8 of the fastener element 2 is formed in a thickness substantially half the thickness of the fastener element 2, and as shown in FIG. 3, the supporting portion 12 is provided integrally with the front surface portion 7 from the proximal portion 10 of the fastener element 2 up to the front end 11 thereof. A neck portion 16, which is constricted narrowly in the width direction, is provided concavely in a middle portion 15 of the supporting portion 12 in the length direction of the fastener element 2, and a expanded coupling head 17, which extends to the right and left in the width direction of the fastener element 2, is provided on the side of the front end 11 following the neck portion 16. A flat plane 14 which is even both in the width direction and length direction of the fastener element 2 is formed on the surface of the rear surface portion 8 of the fastener element 2, as shown in FIG. 4. In the neck portion 16 of the fastener element 2, the supporting portion 12 of the front surface portion 7 projects in the width direction of the fastener element 2. As shown in FIG. 5, the coupling head 17 of the mating fastener element 2 is received by the neck portion 16, so that the fastener elements 2 adjoining in the length direction of the fastener chain 1 can engage mating fastener elements 2 each other. Here, the surface of the rear surface portion 8 of the fastener element 2 is indicated as the surface of the opposite side of the surface of the front surface portion 7 so that they sandwich the fastener tape 4.

The fastener chain 1 is formed as described above. When the right and left fastener elements 2 are engaged with each other through the neck portions 16 on the rear side as shown in FIG. 5, the supporting portion 12 on the front surface of the fastener element 2 in the fastener chain 1 is expanded widely in a circular shape because the central line in the width direction of the fastener element 2 is formed so as to provide the curved face 13 projecting most outwardly from the proximal portion 10 of the fastener element 2 up to the front end 11 thereof. As a result, the fastener element 2 gives an excellent tactile feel and the appearance of the fastener chain 1 can be finished very beautifully. In the meantime, the curvature radius of the curved face 13 is preferred to be in a range of 2.5 mm to 8 mm.

Preferably, the curvature radius is in a range of 4 mm to 5 mm. Because a flat plane is formed on the surface of the rear surface portion 8 of the fastener element 2, the fastener element 2 secures a necessary mounting strength and engagement strength without decreasing considerably the thickness dimensions of the supporting portion 12 on the right and left sides of the rear surface portion 8, particularly, the thickness dimension on both the right and left end portions of the coupling head 17. Consequently, even if an external force such as pulling force or pushing force is applied to the fastener chain 1, the engagement is never released or the fastener element is never damaged simply.

Second Embodiment

Figure 8:
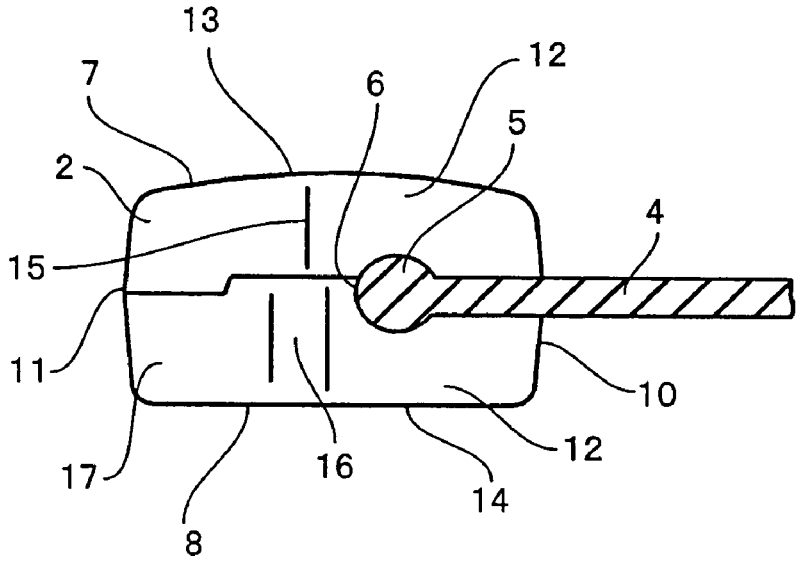
FIG. 8 is a bottom face view showing a bottom face of a fastener stringer according to a second embodiment.

In a slide fastener chain according to a second embodiment shown in FIG. 8, fastener elements 2 are molded on opposing side edges 6 of fastener tapes 4 by injection molding means using the same thermoplastic resin as the first embodiment. In the fastener element 2, a front surface portion 7 is formed on the front side of the fastener tape 4, and a rear surface portion 8 is formed on the rear side thereof. In the front surface portion 7, a supporting portion 12 is formed from a proximal portion 10 of the fastener element 2 up to a front end 11 thereof, and this supporting portion 12 is formed into a shape whose width dimension decreases gradually from a middle portion 15 of the fastener element 2 to the front end 11, that is, a substantially triangular shape. In addition, the surface of the fastener element 2 is formed into a curved shape projecting upward and convexly from the proximal portion 10 to the front end 11, that is, is formed into a curved face 13 which curves so that the center in the length direction of the fastener element 2 projects most in the length direction of the fastener element 2. Other configurations are same as those in the first embodiment.

Third Embodiment

Figure 9:
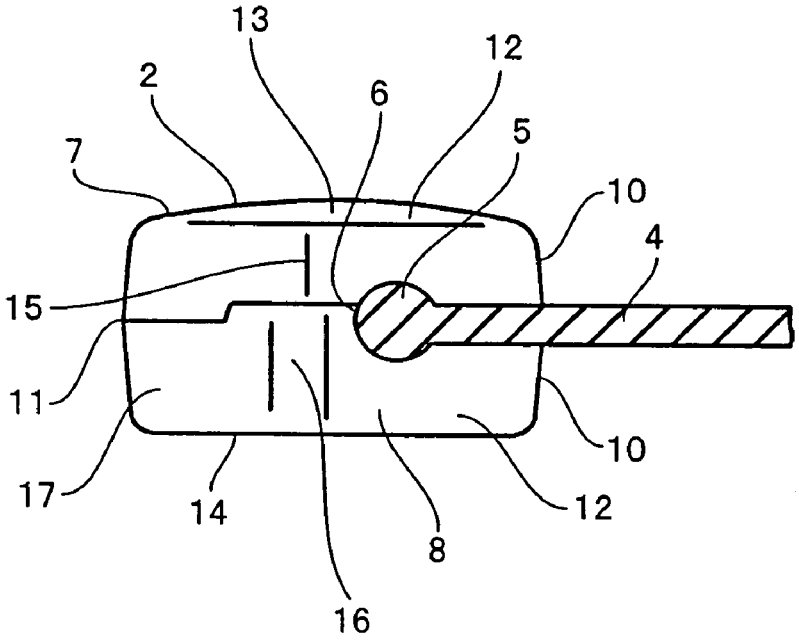
FIG. 9 is a bottom face view showing a bottom face of a fastener stringer according to a third embodiment.
Figure 10:
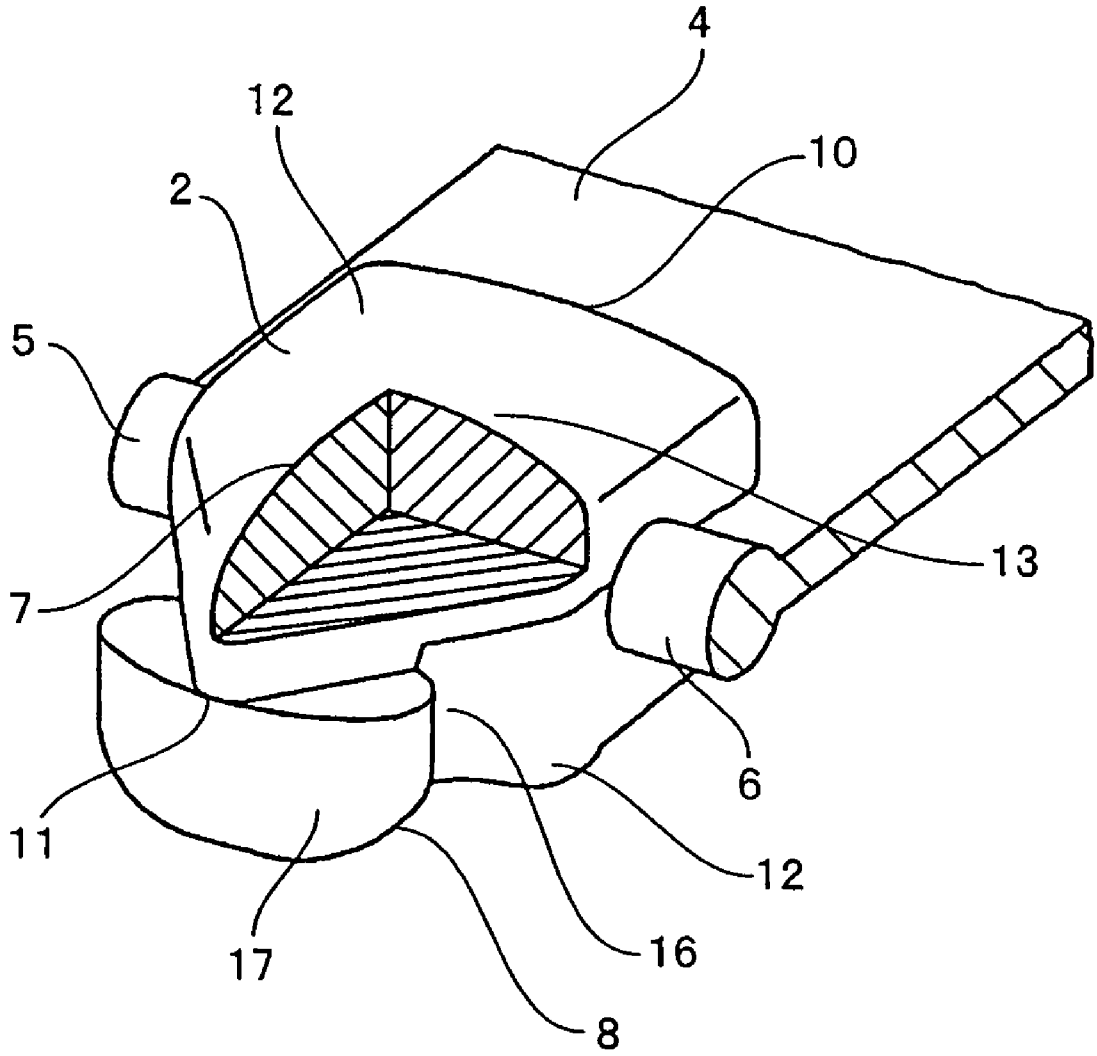
FIG. 10 is a broken-out sectional view showing the inside of the same fastener element.

In a slide fastener chain according to a third embodiment shown in FIGS. 9 and 10, fastener elements 2 are molded on opposing side edges 6 of fastener tapes 4 by injection molding means using the same thermoplastic resin as the above-described embodiments. In each fastener element 2, a front surface portion 7 is formed on the front side of the fastener tape 4, and a rear surface portion 8 is formed on the rear side thereof. In the front surface portion 7, a supporting portion 12 is formed from a proximal portion 10 of the fastener element 2 up to a front end 11 thereof, and this supporting portion 12 is formed into a shape whose width dimension decreases gradually from a middle portion 15 of the fastener element 2 to the front end 11 thereof, that is, a substantially triangular shape. In addition, the surface of the fastener element 2 is formed into a shape in which the central line from the proximal portion 10 up to the front end 11 is curved convexly, that is, projected convexly upward so as to be curved in the width direction of the fastener element 2. Moreover, the surface of the fastener element 2 is formed into a shape curved convexly from the proximal portion 10 up to the front end 11, that is, projected convexly upward so as to be curved in the length direction of the fastener element 2, so that a curved face 13 which is curved convexly upward in two axis directions is provided. Other configurations are same those in the above-described embodiments.

Fourth Embodiment

Figure 11:
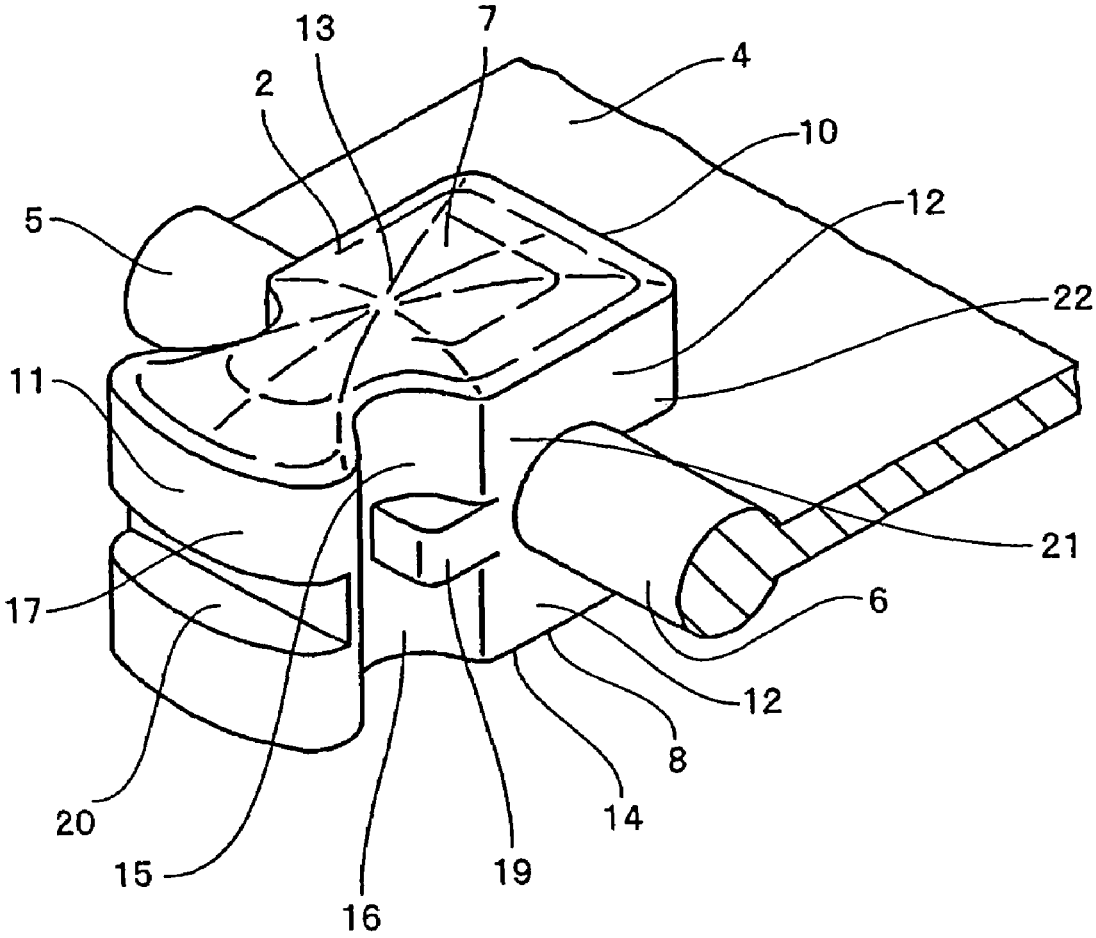
FIG. 11 is a perspective view of a fastener element according to a fourth embodiment.
Figure 12:
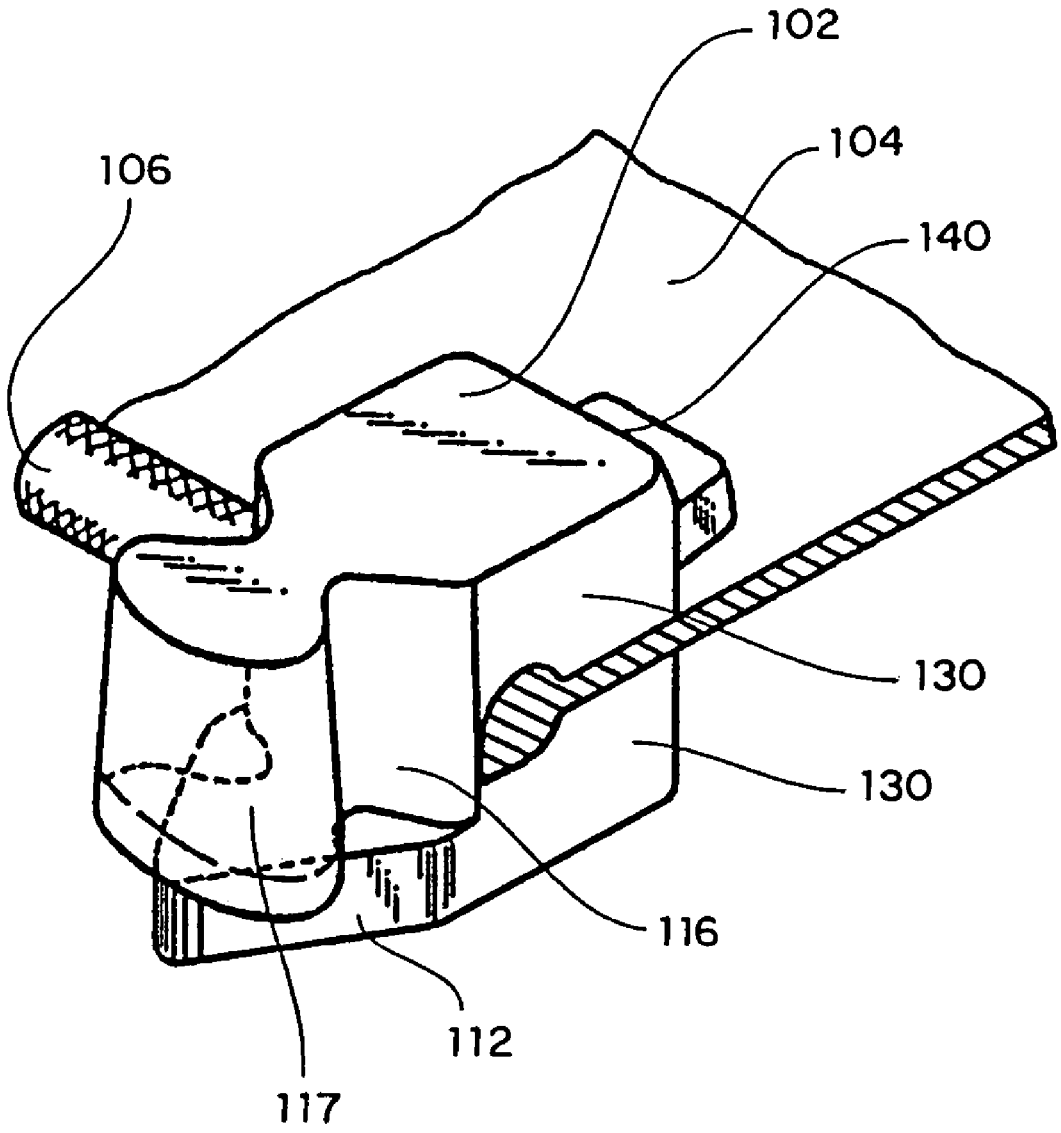
FIG.12 PRIOR ART
FIG. 12 is a perspective view of a well known fastener element.

In a slide fastener chain according to a fourth embodiment shown in FIG. 11, fastener elements 2 are molded on opposing side edges 6 of fastener tapes 4 by injection molding means using the same thermoplastic resin as the above-described embodiments. In the fastener element 2, a front surface portion 7 is formed on the front side of the fastener tape 4, and a rear surface portion 8 is formed on the rear side. The contours forming outlines of the front surface portion 7 and the rear surface portion 8 are formed in the same shape, and supporting portions 12 are formed on the front and rear sides so as to sandwich the fastener tape 4. A constricted neck portion 16 is formed in a middle portion 15 of the supporting portion 12 of the fastener element 2, and an expanded coupling head 17 is provided continuously with the neck portion 16.

In the fastener element 2, the supporting portion 12 has the expanded coupling head 17 provided at the front end 11 if seen in a plan view, and the constricted concave neck portion 16 is provided intrad and continuously, and cubic leg portions 22 are provided continuously with the neck portion 16 in order to fix the fastener element 2 to the fastener tape 4. An angularly projecting engaging protrusion 19 is provided in the center of a side face 21 on the side of the leg portion 22 of the concave neck portion 16, and a depressed engaging concave portion 20, which a mating engaging protrusion 19 can engage, is formed in the front end 11 of the coupling head 17.

The surface of the supporting portion 12 on the front side of the fastener element 2 is projected so as to be curved convexly upward in the length direction of the fastener element 2, that is, from the proximal portion 10 to the front end 11 and at the same time, the curved face 13 is provided in the width direction of the fastener element 2, that is, provided on the center line from the proximal portion 10 to the front end 11 of the fastener element 2 such that it is curved and projected convexly upward. The rear surface portion 8 of the fastener element 2 is entirely formed into a flat plane 14, whereby the front surface portion 7 provides a smooth tactile feel while the rear surface portion 8 secures an excellent mounting strength and engagement strength.

The fastener chain having the fastener elements whose surface is expanded circularly is used at an opening in clothes such as a fly of clothing, and is also used at an opening/closing portion of bags and other products as a fastener chain providing an excellent tactile feeling.

What is claimed is:

1. A slide fastener chain equipped with fastener elements made of synthetic resin at a constant interval along opposing side edges of a pair of fastener tapes, wherein each of the fastener elements has a front surface portion and a rear surface portion which oppose each other on front and rear sides of each fastener element, the front surface portion comprises a supporting portion provided projectingly from a proximal portion to a front end while a width dimension of the supporting portion decreases gradually from a middle portion to the front end, and the front surface portion is formed into a curved face entirely swelling outwardly from a periphery of the supporting portion to a center thereof, and the rear surface portion comprises the supporting portion provided projectingly from the proximal portion to the front end, and the rear surface portion is entirely formed into a flat plane which is even and has no step while the supporting portion is provided with a neck portion in the middle portion and an expanded coupling head at the front end continuously.

2. The slide fastener chain according to claim 1, wherein the front surface portion is formed into the curved face swelling out in a width direction of each fastener element.

3. The slide fastener chain according to claim 1, wherein the front surface portion is formed into the curved face swelling out in a length direction of each fastener element.

4. The slide fastener chain according to claim 1, wherein the front surface portion is formed into the curved face swelling out in a width direction and a length direction of each fastener element.

5. The slide fastener chain according to claim 1, wherein the curved face of the front surface portion is formed into a shape whose curvature radius is in a range of 2.5 mm to 8 mm.

* * * * *